United States Patent [19]

Poliak et al.

[11] 4,360,242

[45] Nov. 23, 1982

[54] SELF-FASTENING ELECTRICAL CONNECTOR

[75] Inventors: John M. Poliak, East Meadow; Juan M. Lopez, Jamaica, both of N.Y.

[73] Assignee: Leviton Manufacturing Co., Inc., Little Neck, N.Y.

[21] Appl. No.: 291,682

[22] Filed: Aug. 10, 1981

Related U.S. Application Data

[63] Continuation of Ser. No. 165,324, Jul. 2, 1980, abandoned.

[51] Int. Cl.[3] ..... H01R 11/20; H01R 13/38

[52] U.S. Cl. ..... 339/99 R

[58] Field of Search ..... 339/99 R, 74 R, 196 R, 339/217 S, 97 R

[56] References Cited

U.S. PATENT DOCUMENTS

| | | | |
|---|---|---|---|
| 2,673,968 | 3/1954 | Smith | 339/99 R |
| 2,769,154 | 10/1956 | Greenbaum | 339/99 R |
| 3,202,954 | 8/1965 | Kinkaid | 339/217 S |
| 3,828,300 | 8/1974 | Codrino | 339/74 R |
| 3,866,997 | 2/1975 | Kreutter | 339/217 S |

FOREIGN PATENT DOCUMENTS

| | | | |
|---|---|---|---|
| 1355758 | 2/1964 | France | 339/217 S |

*Primary Examiner*—Joseph H. McGlynn
*Assistant Examiner*—John S. Brown
*Attorney, Agent, or Firm*—Paul J. Sutton

[57] ABSTRACT

A self-fastening electrical connector suitable for connecting an appliance to a standard AC wall receptacle has prongs pivotally mounted on a moulded body in which there is a channel adapted to receive one end of an insulated wire, the other end of which may be connected to an electrical appliance. The prongs have inwardly directed projections adapted to pierce the insulation of the wires in the channel when the prongs are urged from an open to a closed position and outwardly extending projections adapted to engage complementary notches in a plug housing. The moulded body has additional projections which engage additional notches in the plug housing, when the body and contact prongs are inserted therein, simultaneously to prevent retraction of the assembly formed by the contact prongs and moulded body from the housing. An accessway for a tool is provided through the housing wall adjacent an aperture through which the wire extends to the appliance to permit a tool to be inserted and rotated about a fulcrum also provided in the plug housing to urge the contact and body assembly out of the plug housing.

1 Claim, 9 Drawing Figures

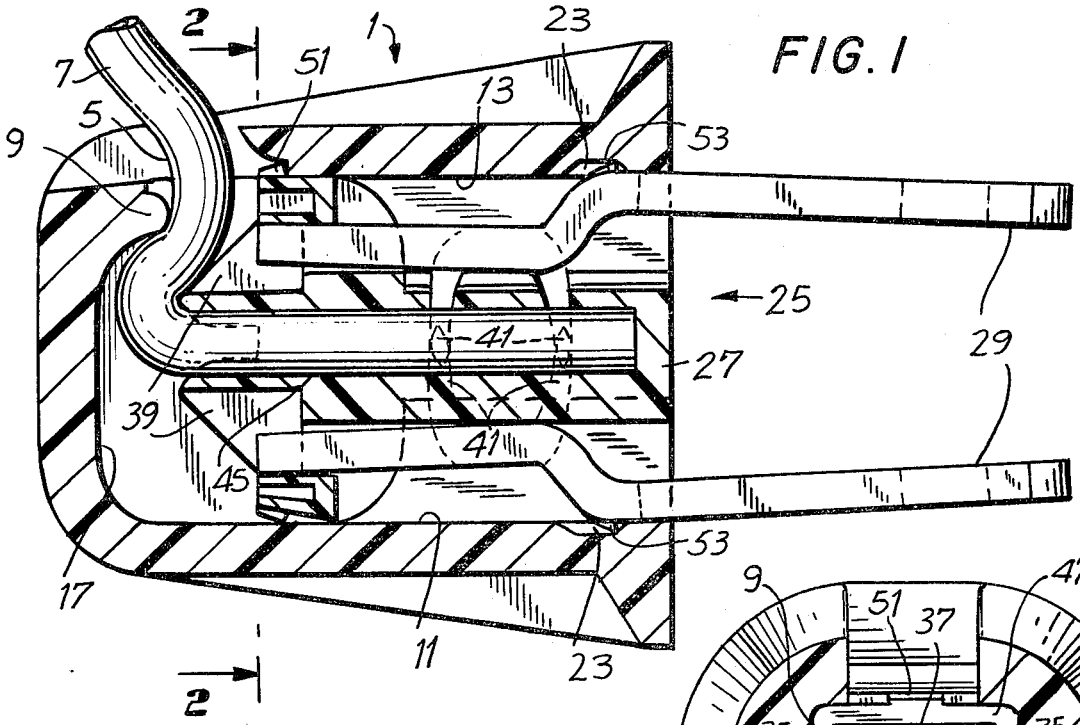
FIG. 1
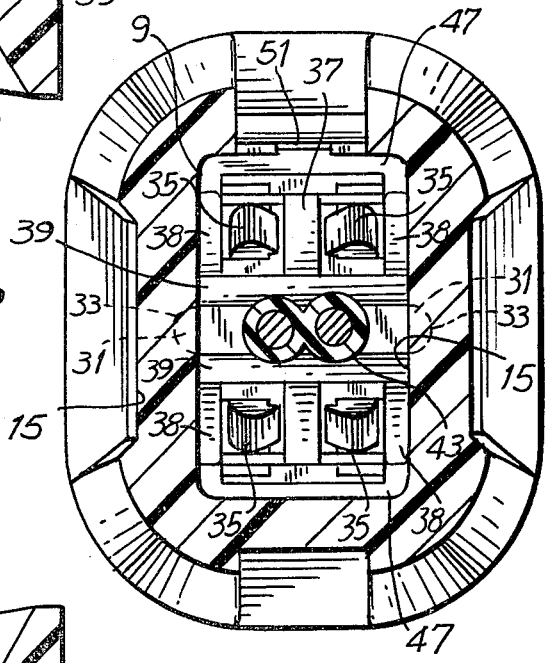
FIG. 2
FIG. 3
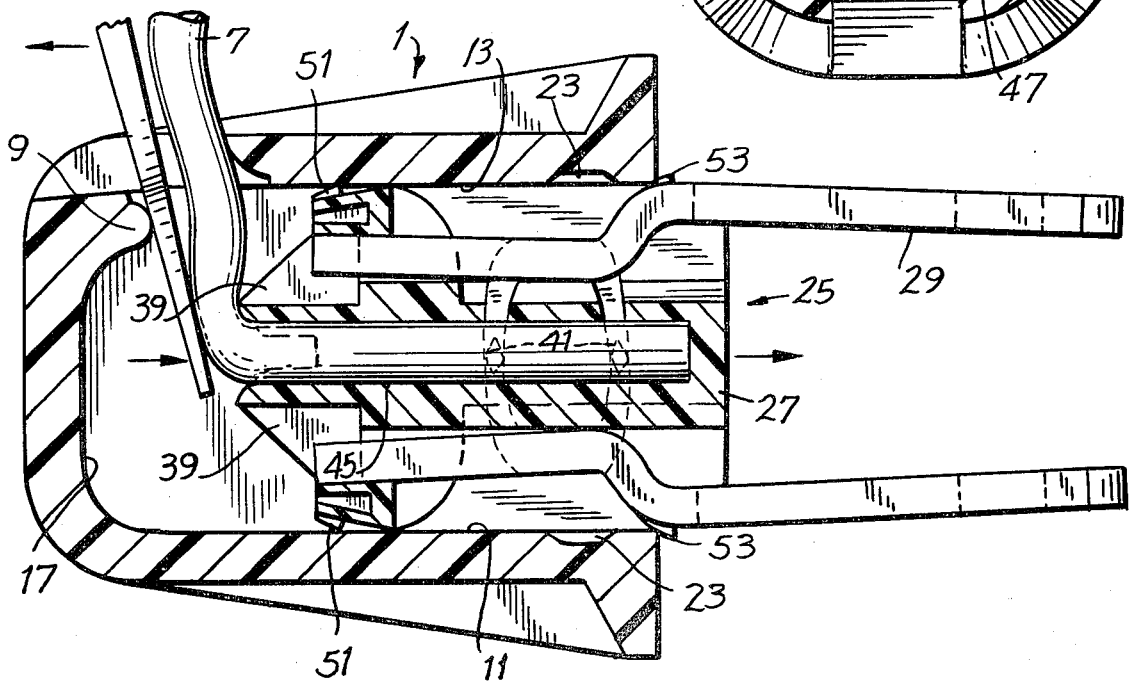

FIG. 4
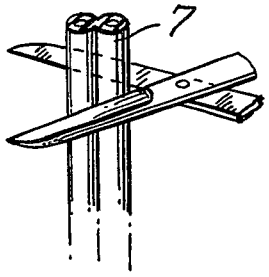
FIG. 5
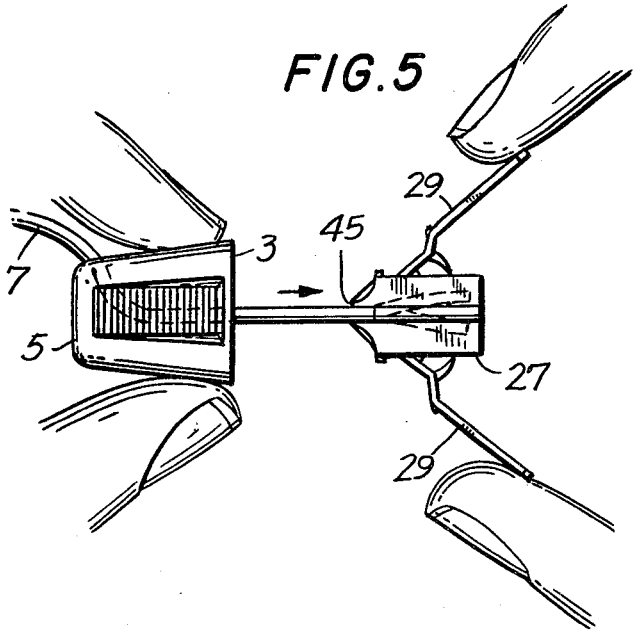
FIG. 6
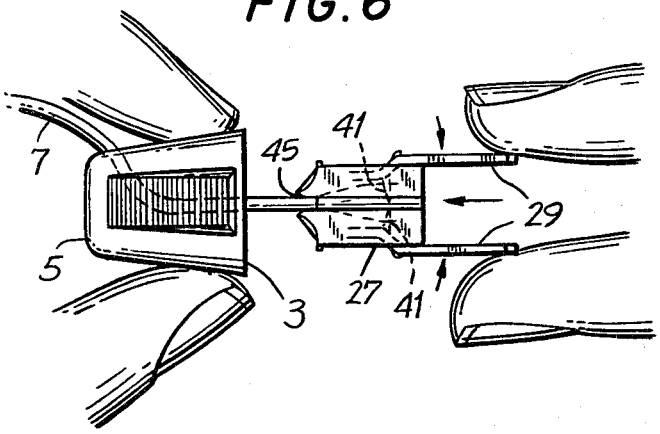
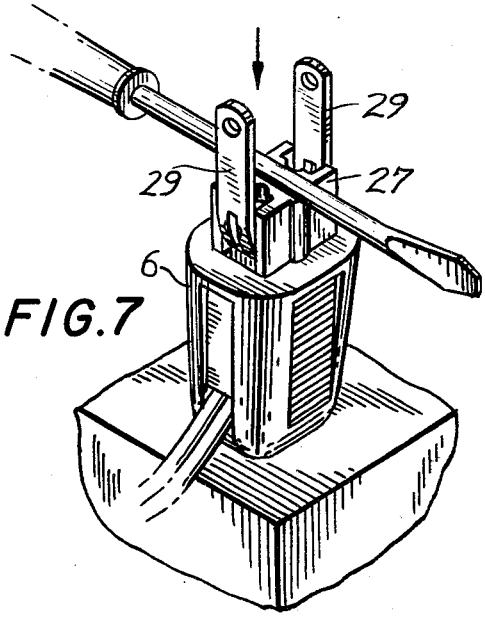
FIG. 7
FIG. 8
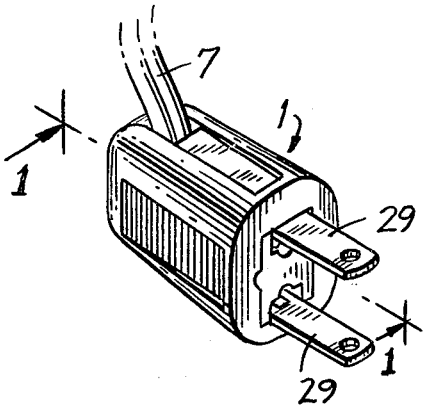
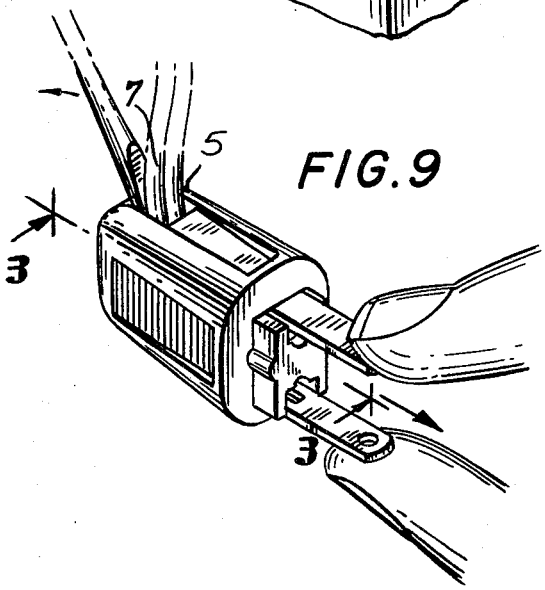
FIG. 9

SELF-FASTENING ELECTRICAL CONNECTOR

This is a continuation of application Ser. No. 165,324, filed July 2, 1980, now abandoned.

BACKGROUND OF THE INVENTION

Electrical appliances adapted to be powered by a standard AC voltage supplied to residences and businesses generally employ a dual conductor wire with each of the conductors covered by a rubber or plastic insulation. The wire is attached to the power input terminal of the appliance at one end and at the other end to a standard male plug having two parallel prongs adapted to be inserted into a standard female wall outlet connected to a power line. Various types of such plugs are known to the art. In one type the wire is inserted through an aperture in the rear of the plug and the insulation about the end of the wire is stripped away so that bare portions of the conductors can be affixed to two screws which are in electrical contact with the prongs of the plug. In another type of plug the wire is permanently attached to the prongs with the plug moulded around it during fabrication of the plug. The former type of plug requires a time-consuming effort in stripping the wires and attaching the stripped wires to the screws and is expensive to use in mass scale production. Moreover, consumers who wish to replace damaged plugs sometimes find it difficult to perform the necessary operations for attaching such plugs and/or lack the tools necessary to properly attach the plug to a wire. The permanently attached plug has the disadvantage that it cannot be re-used.

To overcome the problem associated with the foregoing type of connectors, plugs have been developed wherein a wire can be inserted through a plug housing and then pierced by projections on the plug prongs to achieve electrical contact without stripping the insulation from the wire. Such devices have, until now, been troublesome in that the prongs of the plug which must be separated from the plug housing to connect the wire tend to separate from the housing when the plug is withdrawn from an outlet in some instances. In other instances, the prongs are so strongly held within the housing that any attempt to remove them from the housing to re-use the plug may result in cracking of the housing and breaking or bending of the plug's conductors, thereby irreparably damaging the plug and requiring its replacement.

SUMMARY OF THE INVENTION

The foregoing problems of prior art electrical conductors are overcome by the invention which teaches the construction and use of an electrical connector having a housing the interior walls of which have two spaced grooves and a plug assembly comprising two conducting prong-like contact members pivotally mounted on a moulded body, the prongs having protuberances adapted to be captured in one pair of the notches on the interior wall of the housing and the moulded body having another pair of protuberances adapted to be captured in another notch on the interior wall of the housing simultaneously with the capture of the protuberances on the prong members to securely hold the plug assembly in place in the housing. The housing is further provided with a guideway adjacent an aperture through which the wire connected to the prongs extend for inserting a tool into the housing adjacent the wire and an integrally formed fulcrum about which the tool can be pivoted to urge the protuberances on the moulded body and the prong members out of their respective notches in the housing while simultaneously urging the entire plug assembly out of the housing.

It is therefore an object of the invention to provide a connector for an insulated wire which can be attached without stripping the insulation from the wire.

Another object of the invention is to provide a connector which can be attached to a wire without the need for any tool.

Another object of the invention is to provide a connector which can be assembled with a wire and which will not become inadvertently disassembled.

A further object of the invention is to provide a connector which can be assembled with a wire and which can be disassembled for re-use with the aid of a standard tool.

Other and further objects of the invention will be apparent from the following drawings and description of a preferred embodiment in which like reference numerals are used to indicate like parts in the various views.

DESCRIPTION OF THE DRAWINGS

FIG. 1 is a sectional side elevation of the apparatus of the invention completely assembled;

FIG. 2 is a rear sectional elevation of the apparatus of the invention taken through the line 1—1 of FIG. 1;

FIG. 3 is a side sectional elevation of the apparatus of the invention during disassembly of it;

FIG. 4 is a perspective view showing the preparation of a wire for use with the apparatus of the invention;

FIG. 5 is a side elevation showing an initial stage of assembly of the apparatus of the invention;

FIG. 6 is a side elevation showing a later stage of assembly of the apparatus of the invention;

FIG. 7 is a perspective view showing an even still later stage of assembly of the apparatus of the invention;

FIG. 8 is a perspective view of the apparatus of the invention fully assembled; and FIG. 9 is a perspective view of the apparatus of the invention during disassembly.

DESCRIPTION OF THE PREFERRED EMBODIMENT

Referring now to FIGS. 1, 2 and 3, there is shown a connector 1 according to the invention having a housing 3 apertured at 5 to receive an insulated wire 7. The housing 3 is hollow and has a substantially rectangular bore 9 defining interior surfaces of the housing 3 including a floor 11, a ceiling 13, opposing side walls 15, and a rear wall 17.

Adjacent the aperture 5 in the ceiling 13 of the housing 3 and integral with the rear wall 17 is a ridge 19 traversing the rear wall 17 and parallel to the interior surface of the ceiling 13.

Formed on the ceiling 13 of the housing is a notch 21 and mutually opposing notches 23 laterally displaced from said notch 21.

Disposed within the housing 1 and adapted to be removed therefrom and inserted therein is a plug assembly 25 including a moulded body 27 and conductor prong contact members 29. The moulded body 27 is provided on either of its sides with a laterally extending ridge 31 and the interior surfaces of the side walls 15 of the housing have formed therein respective complementary grooves in which the ridges 31 are slidably disposed when the moulded body 27 is inserted in the housing 3.

Disposed within recesses in the body 27 facing the floor 11 and ceiling 13 of the housing 3 are the wire ends of the conductive prong contact members 29. The wire ends of the prongs 29 terminate in forked portions 35 (best seen in FIG. 2) disposed in respective square apertures laterally separated by a vertical wall member 37 about which the forked portions 35 of the prongs 29 are disposed. The forked ends 35 of the prongs 29 are provided with hook-like barbs and taper toward the wire sides of the prongs 29 so that they can be forced through the apertures in the resilient moulded body and hooked about the central vertical wall member 37 so that they cannot be readily withdrawn from the body 27. In this position with the plug assembly 25 withdrawn from the housing 3 the prong members 29 can be pivoted away from one another into an open position as shown in FIG. 5 in which the prongs are spread apart and rotated or pivoted toward one another into a closed position where the prongs are substantially parallel to one another or possibly taper slightly inwardly for enhanced graspings of the wall receptacle.

At the wire end of the moulded body 27 there are inward tapering members 39 one of which engages the wire 7 and wedges it into an S-shape in cooperation with the ridge 19 on the housing rear wall 17 to entrap the wire between the housing 3 and body 27 when the body 27 is fully inserted in the housing 3. This takes the tensile load on the wire off electrical contacts 41 which extend in U-shaped pairs transversely from conductor prong contact members 29. The contacts 41 are sharply pointed at their ends to enable them to pierce the insulation on the wire 7 and engage the inner wire conductors.

At the wire end of the body 27 there is an opening 43 leading into a channel 45 in which the ends of the wire 7 is disposed when fully inserted into the body 27. The channel is of a shape and dimension defined at least in part by opposing alignment ribs 43*a* which serve to accommodate wire and variations in sizes such that the dual wire conductors are snugly held side by side with each conductor being in alignment with a pair of contacts 41 from respective prong members 29. As each prong member 29 is pivoted from an open position to a closed position the contacts 41 extending transversely inwardly from it pierce the insulation of one of the conductors, and the contact members 41 on the other prong member 29 pierce the insulation of the other conductor so that the two prong members are respectively brought into electrical contact with the two conductors of the dual conductor insulated wire 7 without need for stripping the insulation from the wire 7.

Adjacent the floor 11 and ceiling 13 of the body 27 respectively are body members 47 which are transverse to the vertical members 37 and with vertical members 37, side walls 38 and protruding wedge members 39, frame the apertures in which the forked portions 35 of prongs 29 are disposed. The transverse body members 47 each contain lateral grooves to leave a void beneath portions of the transverse members 47 on which there are integrally mounted protuberances 51. This gives added resiliency to the protuberances 51 which are intended to be forced inwardly toward one another as the body 27 is urged into the bore of the housing 3 and to then resiliently expand such that one of said protuberances 51 enters notch 21 and is resiliently biased toward this notch by the spring-like inward deflection of opposing protuberances 51, thereby assisting in entrapping the body 27 within the housing 3. The protuberances 51 have cam surfaces which cause them to be forced inwardly toward one another as the body 27 is slid along the bore of the housing 3.

There are formed on the prong members 29 additional protuberances 53 which also have cam surfaces causing the prongs 29 to be urged toward one another as the plug assembly 25 is inserted into the housing 3. The resilient prongs 29 spread apart as the protuberances 53 align with the notches 23, thereby forcing the protuberances 53 into the notches 23 and entrapping them there to further aid in capture of the plug assembly 25 within the housing 3, thereby preventing inadvertent separation of the plug assembly 25 from the housing 3.

The aperture 5 in the housing 3 through which the wire is admitted and the transverse ridge 19 cooperate and form a guideway for a narrow flat tool such as a conventional screwdriver which can be inserted through the aperture 5 adjacent the wire 7 to separate the plug assembly 25 from the housing 3 after it is fully inserted and entrapped therein. By first or simultaneously squeezing and maintaining squeeze-like pressure of the blades toward one another, and inserting a screwdriver in the aperture 5 as shown in FIG. 3 and then rotating it about the ridge 19 which serves as a fulcrum for the screwdriver, sufficient force can be applied to the body 27 through the wire 7 to free the protuberance 51 and 53 from the respective notches 21 and 23 and to move the plug assembly 25 through the bore in the housing 3 for disassembly. The prongs 29 can then be spread from the closed position to an open position thereby releasing the grasp of the contacts 41 on the insulated wire whereby the wire can be removed and the plug connector 1 re-used.

In the use of the apparatus of the invention, a dual conductor insulated wire is first evenly cut in a plane parallel to the axis of the wires as shown in FIG. 4. The wire 7 is then threaded through the aperture 5 into the housing 3 and out through the bore opening of the housing 3 and into the channel 45 in the moulded body 27 until penetration is complete (FIG. 5). This is done with the prongs 29 spread apart into the open position after which the prongs are then pivoted to a closed position as shown in FIG. 6. At this time the contacts 41 puncture the insulation of the wire and make electrical contact with the conductors in the wire. The body 27 is then forced fully into the housing 6 either by hand or, in cases where an oversized wire is used, by use of a screwdriver or similar tool as shown in FIG. 7. The fully assembled connector with wire appears as shown in FIG. 8.

To disassemble the connector and wire, a screwdriver is inserted in the aperture 5 behind the wire 7 as previously explained and rotated about the fulcrum formed by the ridge 19 within the housing 3 while the prongs 29 are urged together to disengage the protuberances 53 from respective notches at which time the plug assembly 25 is forced outwardly as shown in FIG. 9.

It will be appreciated that the foregoing description is of a preferred embodiment of the invention and that there are variations and alterations which can be made without departing from the scope and spirit of the invention. The connector, for example, may be of a different type than a common household plug as is used in electrical connections other than those made with common wall receptacles. Although the preferred embodiment has been shown with two protuberances on each of the plug assembly body and the conducting prongs, fewer or greater numbers of protuberances and complementary notches can be used. These are only some of the variations which can be made.

What is claimed is:

1. In an electrical connector comprising a housing having a bore substantially rectangular in cross-section and defining interior surfaces including opposite side walls, a floor, a ceiling and a rear wall, the exterior of said housing having an aperture communicating with said bore for admitting an insulated wire therethrough, a plug assembly adapted to be inserted into the bore of said housing, said plug assembly having a moulded body and at least one conductive electrical contact means pivotally mounted in said body for movement between an open position and a closed position and extending from said bore when in said closed position with said plug assembly fully inserted in said bore, said body having a channel adjacent said contact means and adapted to receive a length of insulated wire when said contact means is in said open position, said contact means having at least one protuberance extending therefrom adapted to pierce the insulation of said wire and engage said wire for electrical contact when said wire is in said channel and said contact means is moved from said open position to said closed position, the improvement which comprises:

first cooperating means on at least one of said interior surfaces of said housing and on said plug assembly for releasably entrapping said body in said housing upon insertion of said plug assembly in said housing, including a protuberance resiliently mounted on one of a surface of said plug assembly and a notch on the interior surface of said housing, an opposite side of said interior surface having a notch adapted to receive said protuberance, said cooperating means on said plug assembly being integral with said body, said wall of said housing having said wire admitting aperture adapted to receive a narrow flat tool between said wall and said wire, said tool penetrating the bore of said housing sufficiently to contact said wire adjacent said body, the interior surface of said housing adjacent said wire aperture having mounted thereon a fulcrum means about which said tool can be pivoted against said wire and said body to urge said protuberance out of said notch while urging said plug assembly away from said housing rear wall and out of said housing, said cooperating means on said plug assembly being integral with said contact means, said protuberance being urged out of said notch upon urging of said contact means towards said closed position.

* * * * *